US011535478B2

(12) United States Patent
Ohashi

(10) Patent No.: US 11,535,478 B2
(45) Date of Patent: Dec. 27, 2022

(54) IMAGE PRINTING APPARATUS, CONTROL METHOD OF IMAGE PRINTING APPARATUS, AND STORAGE MEDIUM

(71) Applicant: CANON KABUSHIKI KAISHA, Tokyo (JP)

(72) Inventor: Takakazu Ohashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/155,282

(22) Filed: Jan. 22, 2021

(65) Prior Publication Data

US 2021/0238000 A1 Aug. 5, 2021

(30) Foreign Application Priority Data

Jan. 30, 2020 (JP) ..... JP2020-013366

(51) Int. Cl.
*B65H 5/20* (2006.01)
*B65H 35/04* (2006.01)
*B65H 43/00* (2006.01)

(52) U.S. Cl.
CPC ..... *B65H 35/04* (2013.01); *B65H 43/00* (2013.01); *B65H 2301/20* (2013.01); *B65H 2301/5151* (2013.01); *B65H 2301/542* (2013.01)

(58) Field of Classification Search
CPC ..... B65H 43/00; B65H 2301/20; B65H 2301/5151; B65H 2301/542; B65H 35/04; B26D 5/00; B26D 5/20; B26D 1/04; B26D 1/045; B41J 11/663; B41J 11/66; B41J 11/70; B41J 11/706
See application file for complete search history.

(56) References Cited

U.S. PATENT DOCUMENTS 4,981,059 A * 1/1991 Kobayashi ..... B41J 11/706 400/621
5,222,818 A * 6/1993 Akiyama ..... B41J 3/4075 346/24

(Continued)

FOREIGN PATENT DOCUMENTS

| | | | |
|---|---|---|---|
| EP | 0914959 | A2 | 5/1999 |
| GB | 2228448 | A | 8/1990 |
| JP | 2017-080917 | A | 5/2017 |

OTHER PUBLICATIONS

Search Report dated Jun. 29, 2021, in European Patent Application No. 21153487.0.

*Primary Examiner* — Leslie A Nicholson, III
(74) *Attorney, Agent, or Firm* — Venable LLP

(57) ABSTRACT

An object of the present invention is to improve throughput of continuous printing in an image printing apparatus having a cutting device that needs to be returned to a standby position for a next cutting operation. One embodiment of the present invention is an image printing apparatus having a printing unit, a conveyance unit capable of conveying a printing medium in a conveyance direction or in a returning direction opposite to the conveyance direction; and a cutting unit provided at a cutting position on a downstream side in the conveyance direction of the printing unit and configured to cut the printing medium by moving in a first direction and return to a cutting standby position for a next cutting operation by moving in a second direction opposite to the first direction.

22 Claims, 11 Drawing Sheets

(56) References Cited

U.S. PATENT DOCUMENTS

| | | | | |
|---|---|---|---|---|
| 6,089,771 | A * | 7/2000 | Watanabe | B41J 11/663 400/615.2 |
| 6,260,457 | B1 | 7/2001 | Hakkaku | |
| 6,874,418 | B2 * | 4/2005 | Ullrich | B65H 35/06 101/226 |
| 8,469,477 | B2 * | 6/2013 | Hiroike | B41J 11/42 347/16 |
| 8,636,431 | B2 * | 1/2014 | Crystal | B65H 35/0086 400/621 |
| 9,493,018 | B2 * | 11/2016 | Nishikawa | B26D 1/045 |
| 9,789,709 | B2 * | 10/2017 | Saiga | B41J 11/663 |
| 2016/0101636 | A1 | 4/2016 | Kanada et al. | |

* cited by examiner

| CONTINUOUS PRINTING MODE | PRINT DATA |
|---|---|
| FIRST CONTINUOUS PRINTING MODE | PRIORITY IS GIVEN TO THROUGHPUT |
| SECOND CONTINUOUS PRINTING MODE | PRIORITY IS GIVEN TO BALANCE |
| THIRD CONTINUOUS PRINTING MODE | PRIORITY IS GIVEN TO IMAGE QUALITY |

FIG.10

IMAGE PRINTING APPARATUS, CONTROL METHOD OF IMAGE PRINTING APPARATUS, AND STORAGE MEDIUM

BACKGROUND OF THE INVENTION

Field of the Invention

The present disclosure relates to an image printing apparatus, a control method of an image printing apparatus, and a storage medium.

Description of the Related Art

Conventionally, there is an image printing apparatus configured so as to print an image with a print head on a variety of kinds of printing medium, such as paper, cloth, and a plastic sheet, based on print data output from an OA device, such as a personal computer. As the scanning method in an image printing apparatus, there are a serial type and a line type.

The serial type is a method of performing a printing operation based on print data by printing an image while alternately repeating main scanning in which a print head is caused to reciprocate in a direction perpendicular to a conveyance direction of a printing medium and sub scanning in which a printing medium is conveyed by a unit conveyance amount, which is a predetermined pitch. On the other hand, the line type is a method of performing a printing operation based on print data by printing an image as well as conveying a printing medium by using a print head having a length substantially equal to the width of the printing medium. Further, in an image printing apparatus that uses roll paper as a printing medium, it is made possible to cut the printing medium for each page and into a sheet shape by providing a cutting device in the image printing apparatus.

In a serial-type image printing apparatus that uses roll paper as a printing medium, in a case where a printing operation is completed, the printing medium is conveyed up to a cutting position and the printing medium is cut by a cutting device. In performing continuous printing, in a case where the printing medium is conveyed up to the cutting position each time the printing operation of a page is completed and the cutting operation is performed, it is not possible to efficiently perform the conveyance operation up to the cutting position and the conveyance operation up to a position at which printing of a next page is started after the cutting operation. Consequently, throughput is reduced.

Consequently, as a technique for improving throughput, the technique of Japanese Patent Laid-Open No. 2017-80917 is known. In Japanese Patent Laid-Open No. 2017-80917, after the printing operation of the first page is completed, the cutting operation of the first page is held in abeyance and the printing operation of the second page is started. Then, the printing operation of the second page is suspended on the way and after performing the cutting operation of the first page, the printing operation of the second page is resumed.

SUMMARY OF THE INVENTION

However, according to Japanese Patent Laid-Open No. 2017-80917, it is not possible to perform the conveyance operation in the feeding direction of the printing medium, which is included in the printing operation of the second page, until the returning operation to the cutting standby position of the cutting device is completed. Consequently, it is not possible to resume the printing operation of the second page immediately after the execution of the cutting operation of the first page. Because of this, there is a room for improvement of throughput.

Consequently, in view of the above-described problem, an object of one embodiment of the present invention is to improve throughput of continuous printing in an image printing apparatus having a cutting device that needs to be returned to the standby position for the next cutting operation.

One embodiment of the present invention is an image printing apparatus including: a printing unit; a conveyance unit capable of conveying a printing medium in a conveyance direction or in a returning direction opposite to the conveyance direction; and a cutting unit provided at a cutting position on a downstream side in the conveyance direction of the printing unit and configured to cut the printing medium by moving in a first direction and return to a cutting standby position for a next cutting operation by moving in a second direction opposite to the first direction, and during a printing operation for a target page, a printing operation by the printing unit is suspended and at the same time, a conveyance operation in the conveyance direction by the conveyance unit is performed, after the conveyance operation, a cutting operation by the cutting unit is performed, and after the cutting operation, in parallel to movement in the second direction of the cutting unit, the printing operation for the target page is resumed.

Further features of the present invention will become apparent from the following description of exemplary embodiments with reference to the attached drawings.

BRIEF DESCRIPTION OF THE DRAWINGS

FIG. 10 is a table for switching the continuous printing modes in the second embodiment.

DESCRIPTION OF THE EMBODIMENTS

First Embodiment

In the following, embodiments of the present invention are explained with reference to the drawings. In the present specification, throughout all the drawings, the same symbol indicates the same or corresponding element.

<Outline configuration of image printing apparatus>

Figure 1:
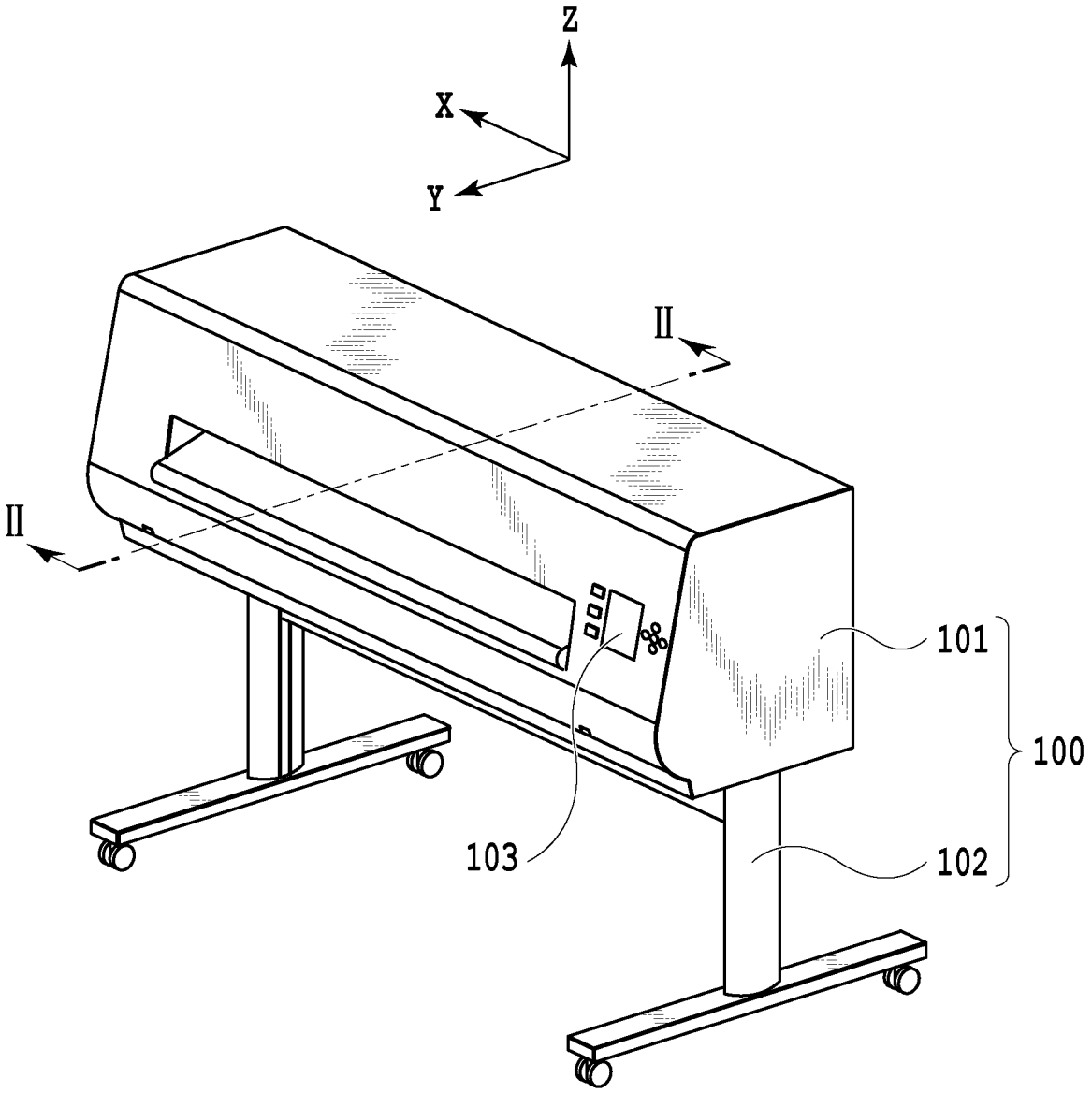
FIG. 1 is a perspective diagram showing an outer appearance of an image printing apparatus in a first embodiment.
Figure 2:
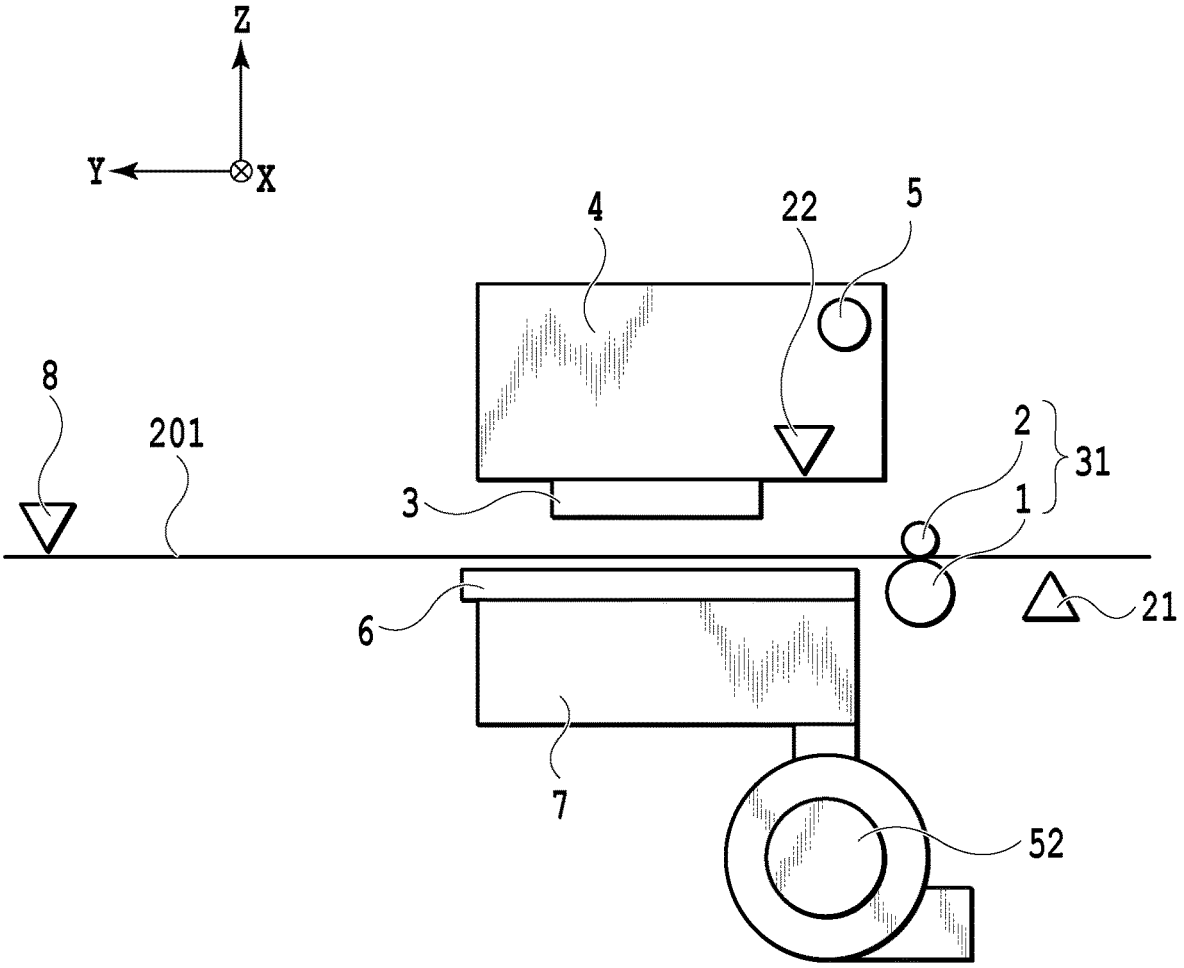
FIG. 2 is a cross-sectional diagram of the image printing apparatus in the first embodiment.

In the following, an outline configuration of an image printing apparatus in the present embodiment is explained by using FIG. 1 and FIG. 2. FIG. 1 is a schematic perspective diagram of an image printing apparatus in the present embodiment. FIG. 2 is a schematic cross-sectional diagram of the image printing apparatus in the present embodiment and shows a cross section obtained by cutting the image printing apparatus by a cross-sectional line II-II in FIG. 1.

It is possible for an image printing apparatus 100 to print an image on a printing medium 201 (see FIG. 2), such as roll paper. The image printing apparatus 100 has a main body portion 101 and a leg portion 102 that supports the main body portion 101. At the outer portion of the main body portion 101, an operation panel 103 capable of displaying, setting, and so on information on the printing medium 201, various kinds of print information and the like is arranged. A conveyance roller 1 and a follower roller 2 are a conveyance roller pair 31 arranged on the upstream side in the conveyance direction (referred to as Y-direction) of an image printing unit as a conveyance unit configured to nip and convey the printing medium 201. It is possible for the conveyance roller pair 31 to convey the printing medium 201 in the +Y-direction or the −Y-direction by the conveyance roller 1 being driven rotationally by a conveyance motor 51 (see FIG. 3).

A sheet sensor 21 is arranged on the upstream side in a conveyance direction Y of the conveyance roller pair 31. The sheet sensor 21 has a light-emitting element and a light-receiving element and is capable of determining whether or not the printing medium 201 exists within the conveyance path by emitting light from the light-emitting element and receiving the reflected light by the light-receiving element.

A carriage 4 mounts a print head 3 that is an image printing unit and a sensor 22 that is a detection unit of a printing medium and is guided and supported so as to be capable of reciprocating in a direction (referred to as X-direction) perpendicular to the Y-direction along a carriage shaft 5 as a scan guide. The sensor 22 mounts a variety of LEDs and capable of detecting the presence/absence of the printing medium 201, the thickness thereof and the like by emitting light from above the printing medium 201 by the light-emitting element and receiving the reflected light. Due to this, it is also made possible to detect the end portion position of the many kinds of the printing medium 201 including a transparent film or the like, which is not paper.

A platen 6 guides and supports the printing medium 201 from the back surface in the image printing unit and secures a gap between the print head 3 and the printing medium 201. In the platen 6, a plurality of intakes is formed and the intakes are connected to a suction fan 52 via a duct 7. By driving the suction fan 52, a suction negative pressure occurs in the intake of the platen 6 and it is possible to absorb and hold the printing medium 201 on the platen 6. A cutter 8 is provided on the downstream side in the Y-direction of the image printing unit and guided and supported so as to be capable of reciprocating in the X-direction perpendicular to the Y-direction. By the cutter 8 moving in the +X-direction by a cutter motor 53 (see FIG. 3), it is possible to cut the printing medium 201 to a predetermined length in the Y-direction.

At the time of printing an image on the printing medium 201, by rotationally driving the conveyance motor 51 in the state where the tip of the printing medium 201 is nipped by the conveyance roller pair 31, the tip of the printing medium 201 is conveyed by a predetermined amount onto the platen 6, which functions as the image printing unit. In a case where an image is printed by the main scanning corresponding to one line by the forward movement or the backward movement of the carriage 4 in the image printing unit, the printing medium 201 is conveyed again by a predetermined pitch in the +Y-direction by the conveyance roller pair 31 and image printing of the next line is performed by moving the carriage 4 again. By repeating the image printing and the printing medium conveyance such as these, an image is printed on the entire page. In a case where the printing operation is completed and there is no print data of the next page, the printing medium 201 is conveyed up to a predetermined cutting position by the conveyance roller pair 31. In a case where the conveyance operation of the printing medium 201 up to the cutting position is completed, by rotationally driving the cutter motor 53, the cutter 8 moves in the +X-direction and cuts the already-printed page of the printing medium 201. Due to this, the already-cut page is separated. In a case where the cutting operation is completed, the cutter 8 moves in the −X-direction and returns to the cutting standby position and the image printing apparatus 100 enters the standby state.

Control Configuration of Image Printing Apparatus

Figure 3:
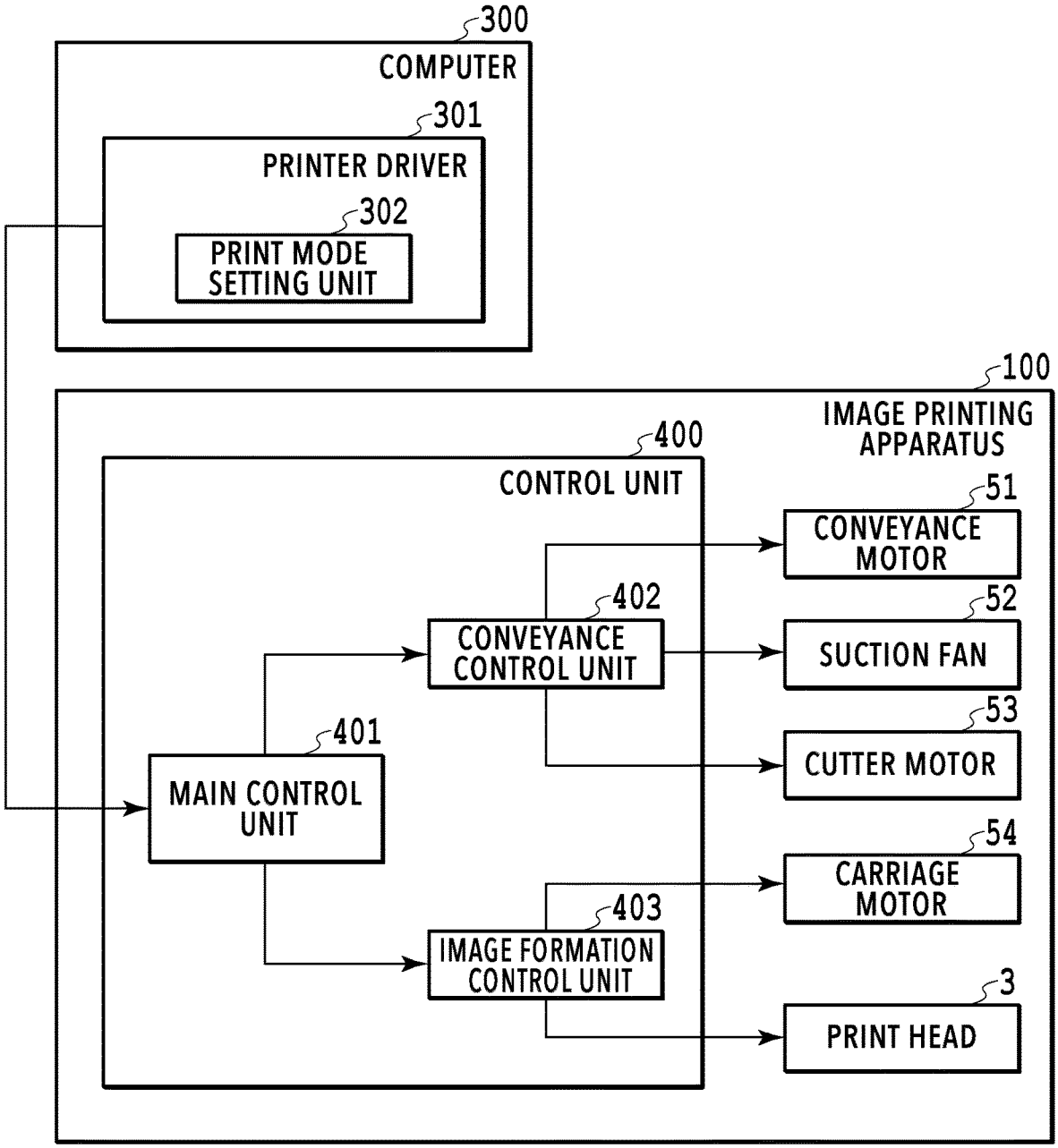
FIG. 3 is a block diagram showing a configuration relating to control of the image printing apparatus in the first embodiment.

In the following, the configuration relating to the control of the image printing apparatus in the present embodiment is explained by using FIG. 3. FIG. 3 is a block diagram showing the configuration relating to the control of the image printing apparatus in the present embodiment.

As shown in FIG. 3, in a computer 300 connected with the image printing apparatus 100, a printer driver 301 is installed. The printer driver 301 has a print mode setting unit 302, which is a function module that sets a print mode. To explain in detail, the print mode setting unit 302 is a unit for causing a user to set the type, print quality and the like of the printing medium 201.

On the other hand, on the image printing apparatus 100, a control unit 400 is configured. The control unit 400 is for implementing the control of the conveyance motor 51, the suction fan 52, the cutter motor 53, a carriage motor 54, and the print head 3. Further, the control unit 400 has a CPU, a ROM, a RAM, a motor driver and the like, which are not shown schematically, and includes a main control unit 401, a conveyance control unit 402, and an image formation control unit 403. The main control unit 401 gives instructions to the conveyance control unit 402 and the image formation control unit 403 in accordance with the print data received from the printer driver 301. The conveyance control unit 402 conveys the printing medium 201 by driving the conveyance motor 51 in the stage where the suction fan 52 is being driven and the image formation control unit 403 forms an image at the due position in cooperation with the carriage motor 54 and the print head 3.

Continuous Printing Mode

Figure 4:
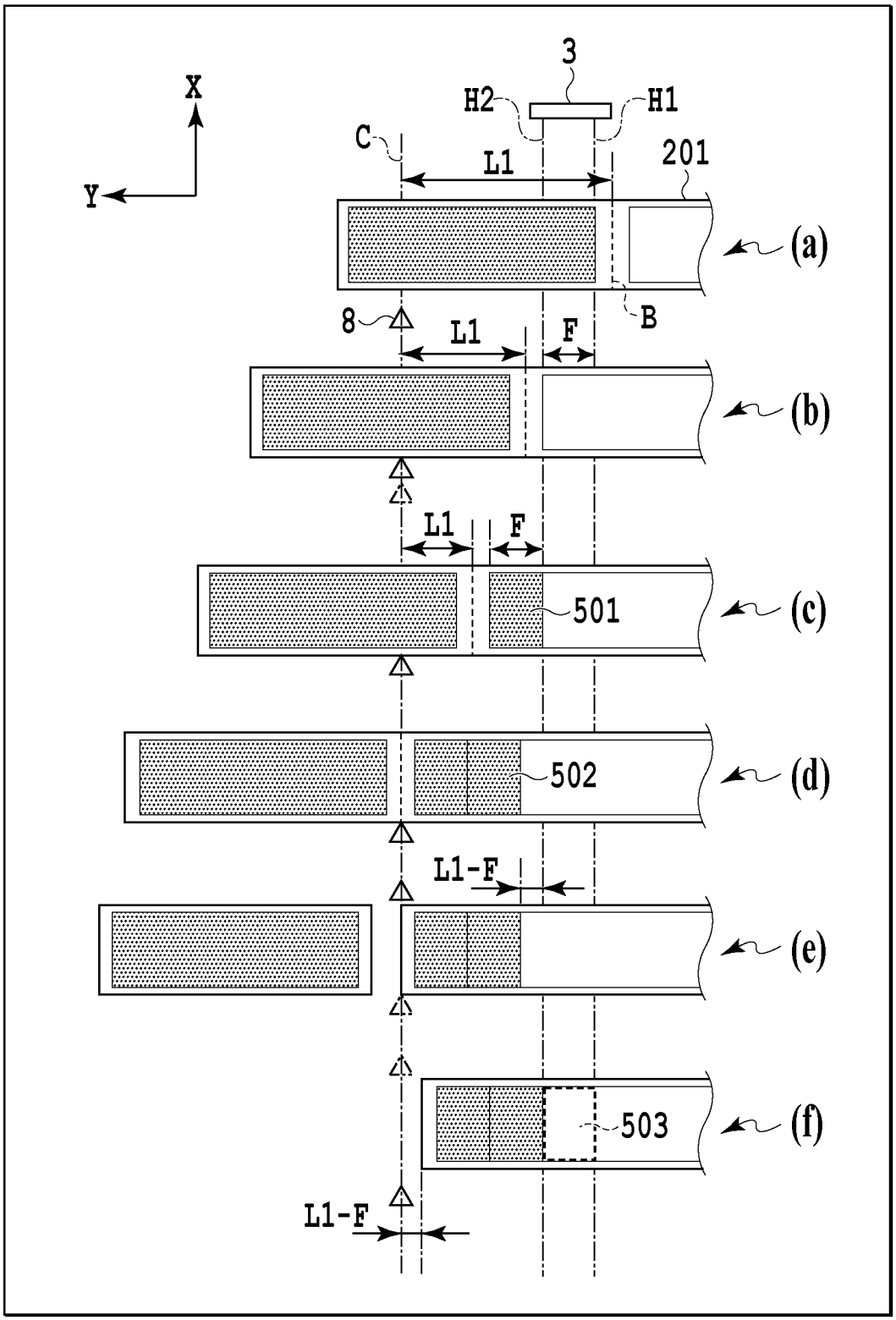
FIG. 4 is a diagram showing a state transition at the time of continuous printing onto roll paper in a first continuous printing mode.

In the following, a mode (referred to as first continuous printing mode) for continuously performing printing on roll paper in the image printing apparatus 100 in the present embodiment is explained by using FIG. 4. FIG. 4 is an explanatory diagram of the first continuous printing mode and specifically, shows a state transition at the time of continuous printing onto roll paper in the first continuous printing mode.

In FIG. 4, a symbol (a) shows a state where the printing operation of the first page is completed. By using nozzles from an uppermost stream nozzle position H1 up to a downmost stream nozzle position H2 in the conveyance direction Y of the print head 3, the printing operation of the first page onto the printing medium 201 is completed. Here, in this example, it is assumed that the distance in the Y-direction between the uppermost stream nozzle position H1 and the downmost stream nozzle position H2 is 27 mm and the distance in the Y-direction between the downmost stream nozzle position H2 and a cutting position C of the cutter 8 is 80 mm. In a case where next print data has not been received, the printing medium 201 is conveyed in the conveyance direction Y by a conveyance amount (referred to as conveyance amount L1 up to cutting position) corresponding to a distance in the conveyance direction Y between the cutting position C of the cutter 8 and a back end position B of the first page. Then, by the cutter 8, the printing medium 201 is cut at the back end position B of the already-printed first page.

On the other hand, in FIG. 4, a symbol (b) shows the state before the start of the printing operation of the second page in a case where the next print data has been received and in a case where the next print data has been received, the cutting operation of the first page is held in abeyance and the printing medium 201 is conveyed in the conveyance direction Y up to the start position of the image printing of the second page. Here, during the period from the completion of the printing operation of the first page until the start of the printing operation of the second page, the cutter 8 moves from a first standby position indicated by the dotted line to a second standby position indicated the solid line, which is the position closer to the printing medium 201. Due to this, the movement distance of the cutter is reduced at the time of the cutting operation of the first page, and therefore, it is made possible to reduce the cutting time. In a case where the cutter 8 is located at the second standby position during the printing operation of the first page, at the time the tip of the printing medium 201 being conveyed to the vicinity of the cutting position C, there is a possibility that a conveyance malfunction occurs, such as a jam caused by the printing medium 201 and the cutter 8 coming into contact with each other due to floating paper or the like of the printing medium 201. Because of this, the cutter 8 is moved during the period from the completion of the printing operation of the first page, which brings about a state where the tip of the printing medium 201 is located on the downstream side in the Y-direction of the cutting position C, until the start of the printing operation of the second page. Then, the printing operation of the second page is started. As to the conveyance after an image 501 of the first line is printed by the main scanning corresponding to one line by the forward movement or the backward movement of the carriage 4, the conveyance control is different in accordance with a relationship between the conveyance amount L1 up to the cutting position and a unit conveyance amount F by which conveyance to the image printing position of the next line is performed. Here, in this example, it is assumed that the unit conveyance amount F is a distance of 27 mm in the Y-direction between the uppermost stream nozzle position H1 and the downmost stream nozzle position H2.

In FIG. 4, a symbol (c) shows a state where the printing operation of the second page is continued and before an image 502 of the second line is printed. Here, the conveyance amount (referred to as unit conveyance amount F) for conveyance to the image printing position of the next line is taken as the distance between the uppermost stream nozzle position H1 and the downmost stream nozzle position H2. At the position of the printing medium 201 shown in (b) of FIG. 4, based on the unit conveyance amount F and the conveyance amount L1 up to the cutting position, whether to perform the cutting operation is determined. Specifically, $(2\times F)<L1$ holds, and therefore, the printing medium 201 is conveyed by the unit conveyance amount in the feeding direction (+Y-direction) with respect to the conveyance direction Y from the position shown in (b) of FIG. 4 and the printing operation is continued. After that, the image 502 of the second line is printed.

Next, in FIG. 4, a symbol (d) shows a state where the printing operation of the second page is suspended and before the cutting operation of the first page is performed. At the position of the printing medium 201 shown in (c) of FIG. 4, based on the unit conveyance amount F and the conveyance amount L1 up to the cutting position, whether to perform the cutting operation is determined. Specifically, $(2\times F)\geq L1$ holds, and therefore, the printing medium 201 is conveyed by an amount corresponding to L1 in the feeding direction (+Y-direction) with respect to the conveyance direction Y from the position shown in (c) of FIG. 4 and the printing operation is suspended.

In FIG. 4, a symbol (e) shows a state after the cutting operation of the first page is performed and by the cutter 8 moving in the +X-direction from the second standby position indicated by the dotted line up to the cutting completion position indicated by the solid line, the printing medium 201 is cut at the back end position B of the first page.

Next, in FIG. 4, a symbol (f) shows a state where the printing operation of the second page is resumed. Here, the returning operation (referred to as returning operation of the cutter 8) of the cutter 8 returning in the −X-direction from the cutting completion position indicated by the dotted line up to the first standby position indicated by the solid line is performed. On the other hand, by the printing medium 201 being conveyed by an amount corresponding to (L1−F) in the returning direction (−Y-direction) with respect to the conveyance direction Y form the position shown in (e) of FIG. 4, the printing medium 201 reaches the position at which an image 503 of the third line is printed. After that, by printing the image 503 of the third line, the printing operation of the second page is resumed. As described above, in the first continuous printing mode, even in a case where the printing operation of the second page is resumed after the cutting operation of the cutter 8, the first conveyance operation of the printing medium 201 is in the returning direction (−Y-direction) with respect to the conveyance direction Y. Consequently, the printing medium 201 is not conveyed to the downstream side of the cutting position C of the cutter 8. Because of this, it is made possible to perform the printing operation of the second page and the returning operation of the cutter 8 in parallel. In a case where the returning operation of the cutter 8 is completed and the printing of the image 503 of the third line is also completed, it is possible to continue the printing operation of the fourth and subsequent lines.

Printing Processing in First Continuous Printing Mode

Figure 5:
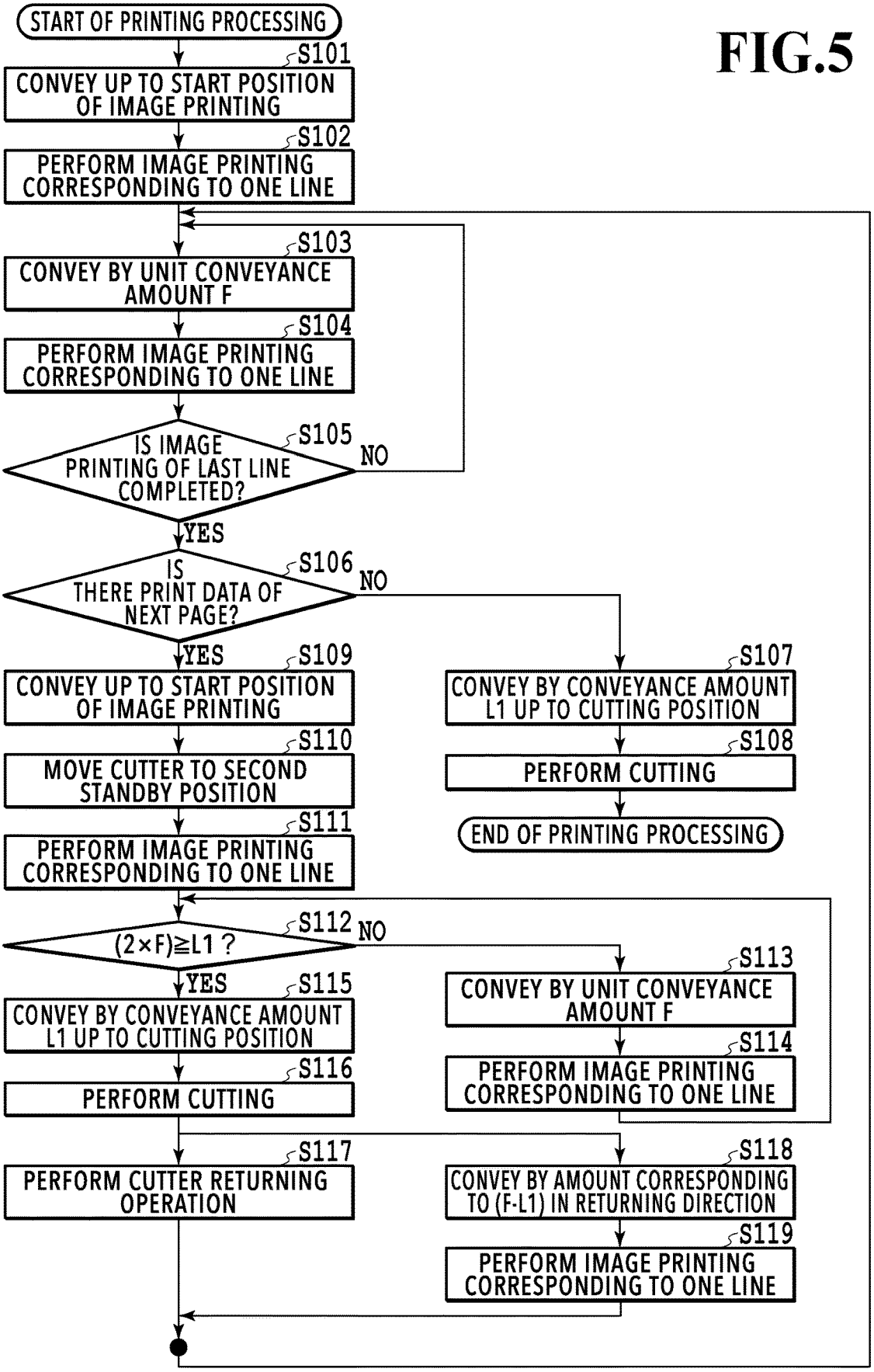
FIG. 5 is a flowchart of printing processing in the first continuous printing mode.

In the following, the series of processing in the first continuous printing mode in the present embodiment is explained by using FIG. 5. FIG. 5 is a flowchart of the printing processing in the first continuous printing mode. The printing processing shown in FIG. 5 is started upon receipt of print data. Further, the processing at each step shown in FIG. 5 is performed by the CPU of the control unit 400.

At step S101, the CPU conveys the printing medium 201 up to the start position of the image printing. In the following, "step S-" is abbreviated to "S-".

At S102, the CPU performs the image printing corresponding to one line.

At S103, the CPU conveys the printing medium 201 by the unit conveyance amount F. By this step, the printing medium 201 is conveyed up to the image printing position of the next line.

At S104, the CPU performs the image printing corresponding to one line.

At S105, the CPU determines whether the image printing of the last line is completed. In a case where the determination results at this step are affirmative, the processing advances to S106 and on the other hand, in a case where the determination results are negative, the processing returns to S103.

At S106, the CPU determines whether the print data of the next page has been received. In a case where the determination results at this step are affirmative, the processing advances to S109 and on the other hand, in a case where the determination results are negative, the processing advances to S107.

At S107, the CPU conveys the printing medium 201 by the conveyance amount L1 up to the cutting position. By this step, the back end position B of the page moves up to the cutting position C of the cutter 8.

At S108, the CPU cuts the printing medium 201 at the back end position B of the page by operating the cutter 8. After that, the CPU returns the printing medium 201 in the returning direction (−Y-direction) up to the standby position and the printing processing is completed.

At S109, the CPU holds the cutting operation of the previous page of the next page that is the target of printing from now (also called target page) in abeyance and conveys the printing medium 201 up to the start position of the image printing of the next page.

At S110, the CPU moves the cutter 8 from the first standby position at which the cutter 8 is located during the printing of the previous page up to the second standby position.

At S111, the CPU performs the image printing corresponding to one line.

At S112, the CPU determines whether to perform the cutting operation based on the unit conveyance amount F and the conveyance amount L1 up to the cutting position, specifically, whether $(2\times F)\geq L1$ holds. In a case where the determination results at this step are affirmative, the processing advances to S115 and on the other hand, in a case where the determination results are negative, the processing advances to S113.

At S113, the CPU conveys the printing medium 201 by the unit conveyance amount F.

At S114, the CPU performs the image printing corresponding to one line and after that, at S112, the CPU determines again whether $(2\times F)\geq L1$ holds.

At S115, the CPU conveys the printing medium 201 by the conveyance amount L1 up to the cutting position.

At S116, the CPU cuts the printing medium 201 at the back end position B by operating the cutter 8.

At S117, the CPU performs the returning operation to return the cutter 8 up to the first standby position.

At S118, the CPU conveys the printing medium 201 by an amount corresponding to (L1−F) in the returning direction (−Y-direction). By this step, the printing medium 201 is conveyed to the image printing position of the next line.

At S119, the CPU performs the image printing corresponding to one line.

Here, the conveyance operation (S118) in the returning direction (−Y-direction) of the printing medium 201, which results in the resumption of the printing operation, and the image printing operation (S119) are performed in parallel to the returning operation of the cutter 8 (S117). In a case where both the returning operation (S117) of the cutter 8 and the image printing operation (S119) are completed, the processing advances to S103. Then, the conveyance corresponding to the unit conveyance amount F for conveying the printing medium 201 up to the image printing position of the next line at S103 and the image printing corresponding to one line at S104 are repeated.

As described above, in the present embodiment, in a case where the continuous printing is performed in the first continuous printing mode, the cutting operation of the previous page is performed during the printing operation of the next page. Further, the cutting operation timing of the previous page is adjusted so that it is possible to perform the conveyance operation (S118) in the returning direction of the printing medium 201, which results in the resumption of the printing operation after the cutting operation of the previous page, and the image printing operation (S119) in parallel to the returning operation of the cutter 8 (S117).

In the embodiment described previously, the cutting operation of the previous page (first page) is performed after the completion of the printing operation of the second line of the next page (second page), but the timing at which the cutting operation of the previous page is performed is not limited to this. For example, the timing may be any timing after the printing operation of the next (second page), such as the timing after the completion of the printing operation of the first line of the next page (second page) and the timing after the completion of the printing operation of the third line of the not next but next page (third page). The timing at which the cutting operation of the previous page is performed changes depending on the margin condition of the print data, the position of the cutting position C and the like.

Further, in the aspect described previously, the unit conveyance amount F for conveying the printing medium to the image printing position of the next line is taken as the distance between the uppermost stream nozzle position H1 and the downmost stream nozzle position H2, but the unit conveyance amount F is not limited to this. For example, a multi-pass configuration may be accepted in which the unit conveyance amount F is the distance ¼ the distance between the uppermost stream nozzle position H1 and the downmost stream nozzle position H2.

Further, in the aspect described previously, the operation direction of the cutter 8 is the same direction (X-direction) as the scanning direction of the carriage 4, but for example, a configuration may be accepted in which the cutter 8 operates in a different direction, such as the Z-direction, and performs cutting.

Effects of the Present Embodiment

As explained above, in the present embodiment, in a case where the continuous printing is performed, the cutting operation of the previous page is performed during the printing operation of the next page and the timing of the cutting operation during the printing operation of the next page is determined based on the unit conveyance amount and the conveyance amount up to the cutting position. Then, the printing medium 201 is not returned in the returning direction (−Y-direction) up to the standby position between pages, but conveyed up to the start position of the image printing of the next page and the timing of the cutting operation is adjusted so that the conveyance operation after the cutting is in the returning direction. By designing the configuration such as this, it is made possible to perform the conveyance operation in the returning direction of the printing medium, which results in the resumption of the printing operation of the next page, and the image printing operation in parallel to the returning operation of the cutter. Consequently, in a case where the continuous printing is performed, it is made possible to efficiently perform the conveyance operation up to the printing start position of the next page and also efficiently perform the returning operation to the cutting standby position of the cutting device after the completion of the cutting of the previous page, and therefore, it is possible to improve throughput.

Second Embodiment

In the present embodiment, the switch control of the continuous printing mode is explained. In the following, differences from the already-described embodiment are explained mainly and explanation of the same configuration as that of the already-described embodiment is omitted appropriately by using the same symbols.

Second Continuous Printing Mode

Figure 6:
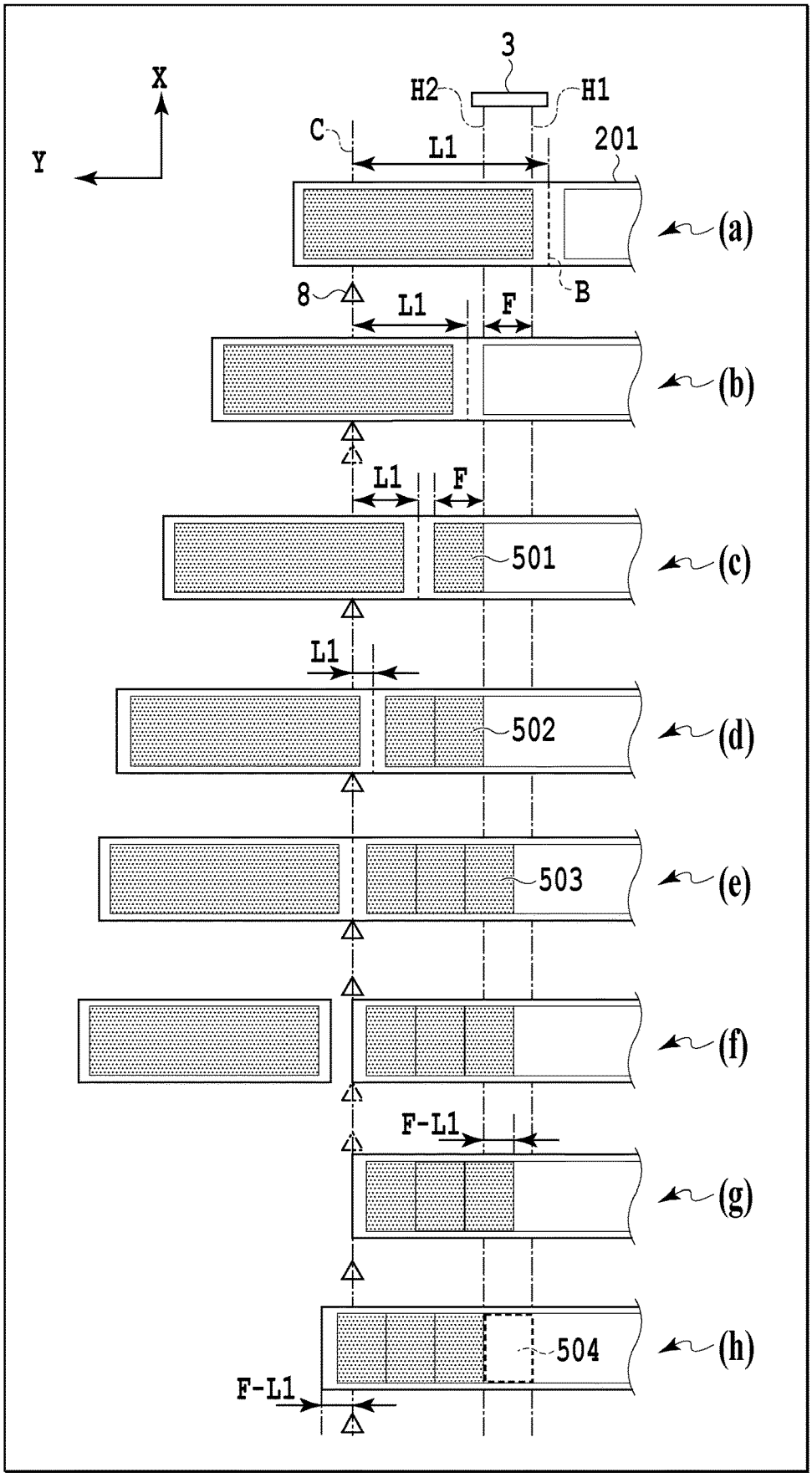
FIG. 6 is a diagram showing a state transition at the time of continuous printing onto roll paper in a second continuous printing mode.

In the following, a mode (referred to as second continuous printing mode) is explained that is different from the first continuous printing mode for continuously performing printing on roll paper in the image printing apparatus 100 in the present embodiment by using FIG. 6. FIG. 6 shows a state transition at the time of continuous printing onto roll paper in the second continuous printing mode.

In FIG. 6, symbols (a) and (b) show the same state as that in the first continuous printing mode (see (a) and (b) in FIG. 4). Then, the printing operation of the second page is started. As to the conveyance after the image 501 of the first line is printed by the main scanning corresponding to one line by the forward movement or the backward movement of the carriage 4, the conveyance control is different in accordance with a relationship between the conveyance amount L1 up to the cutting position and the unit conveyance amount F by which conveyance to the image printing position of the next line is performed.

In FIG. 6, a symbol (c) shows a state where the printing operation of the second page is continued and before the image 502 of the second line is printed. Here, the unit conveyance amount F for conveyance to the image printing position of the next line is taken as the distance between the uppermost stream nozzle position H1 and the downmost stream nozzle position H2. At the position of the printing medium 201 shown in (b) of FIG. 6, based on the unit conveyance amount F and the conveyance amount L1 up to the cutting position, whether to perform the cutting operation is determined. Specifically, F<L1 holds, and therefore, the printing medium 201 is conveyed by the unit conveyance amount F in the feeding direction (+Y-direction) with respect to the conveyance direction Y from the position shown in (b) of FIG. 6 and the printing operation is continued. After that, the image 502 of the second line is printed.

Next, in FIG. 6, a symbol (d) shows a state where the printing operation of the second page is continued and before the image 503 of the third line is printed. As in (b) of FIG. 6, at the position of the printing medium 201 shown in (c) of FIG. 6, based on the unit conveyance amount F and the conveyance amount L1 up to the cutting position, whether to perform the cutting operation is determined. Specifically, F<L1 holds, and therefore, the printing medium 201 is conveyed by an amount corresponding to F in the feeding direction (+Y-direction) with respect to the conveyance direction Y from the position shown in (c) of FIG. 6 and the printing operation is continued. After that, the image 503 of the third line is printed.

Next, in FIG. 6, a symbol (e) shows a state where the printing operation of the second page is suspended and before the cutting operation of the first page is performed. At the position of the printing medium 201 shown in (d) of FIG. 6, based on the unit conveyance amount F and the conveyance amount L1 up to the cutting position, F≥L1 holds, and therefore, the printing medium 201 is conveyed by an amount corresponding to L1 in the feeding direction (+Y-direction) with respect to the conveyance direction Y from the position shown in (d) of FIG. 6 and the printing operation is suspended.

In FIG. 6, a symbol (f) shows a state after the cutting operation of the first page is performed and by the cutter 8 moving in the +X-direction from the second standby position indicated by the dotted line up to the cutting completion position indicated by the solid line, the printing medium 201 is cut at the back end position B of the first page.

Next, in FIG. 6, a symbol (g) shows a state where the printing operation of the second page is resumed, and the returning operation (referred to as returning operation of the cutter 8) of the cutter 8 returning in the −X-direction from the cutting completion position indicated by the dotted line up to the first standby position indicated by the solid line is performed.

In FIG. 6, a symbol (h) shows a state where the printing operation of the second page is resumed. By the printing medium 201 being conveyed by an amount corresponding to (F−L1) in the feeding direction (+Y-direction) with respect to the conveyance direction Y from the position shown in (g) of FIG. 6, the printing medium 201 reaches the position at which an image 504 of the fourth line is printed. After that, by printing the image 504 of the fourth line, the printing operation of the second page is resumed. As described above, in the second continuous printing mode, after the cutting operation of the cutter 8, the printing operation of the second page is resumed after the returning operation of the cutter 8 is completed. Because of this, in the second continuous printing mode, throughput is reduced by an amount corresponding to about the returning operation of the cutter 8 compared to that in the first continuous printing mode. On the other hand, in the first continuous printing mode, the absolute value of the conveyance amount up to the line that is printed after the cutting operation becomes large for the image of the line printed before the cutting operation of the cutter 8, and therefore, there is a possibility that the conveyance accuracy is reduced accordingly compared to that in the second continuous printing mode. The reason is that in the first continuous printing mode, the conveyance operation is performed by the total conveyance amount of the conveyance amount L1 up to the cutting position and the amount corresponding to (L1−F) as the absolute value, but in the second continuous printing mode, the conveyance operation is performed only by the unit conveyance amount F in total. Here, the conveyance amount L1 up to the cutting position, which corresponds to the conveyance amount before the cutting operation in the first continuous printing mode, is larger than the unit conveyance amount F, and therefore, the absolute value of the conveyance amount is larger in the first continuous printing mode than in the second continuous printing mode.

Printing Processing in Second Continuous Printing Mode

Figure 7:
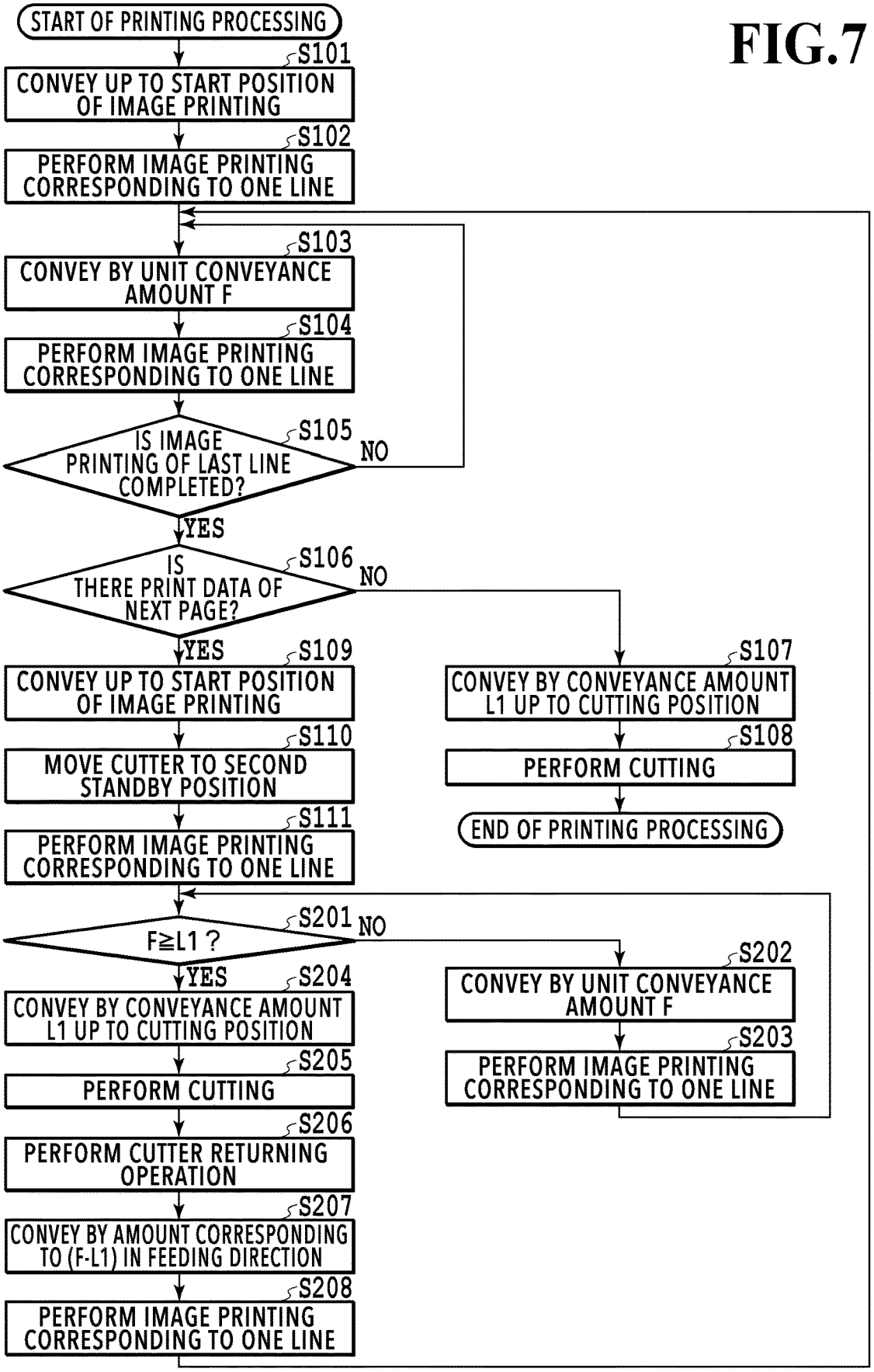
FIG. 7 is a flowchart of printing processing in the second continuous printing mode.

In the following, the series of processing in the second continuous printing mode in the present embodiment is explained by using FIG. 7. FIG. 7 is a flowchart of the printing processing in the second continuous printing mode. The printing processing shown in FIG. 7 is started upon receipt of print data. Further, the processing at each step shown in FIG. 7 is performed by the CPU of the control unit 400.

S101 to S111 are the same as those of the first embodiment (see FIG. 5). After S111, the processing advances to S201.

At S201, the CPU determines whether to perform the cutting operation based on the unit conveyance amount F and the conveyance amount L1 up to the cutting position, specifically, whether F≥L1 holds. In a case where the determination results at this step are affirmative, the processing advances to S204 and on the other hand, in a case where the determination results are negative, the processing advances to S202.

At S202, the CPU conveys the printing medium 201 by the unit conveyance amount F.

At S203, the CPU performs the image printing corresponding to one line and after that, at S201, the CPU determines again whether F≥L1 holds.

At S204, the CPU conveys the printing medium 201 by the conveyance amount L1 up to the cutting position.

At S205, the CPU cuts the printing medium 201 at the back end position B of the previous page by operating the cutter 8.

At S206, the CPU performs the returning operation to return the cutter 8 up to the first standby position.

At S207, the CPU conveys the printing medium 201 by an amount corresponding to (F−L1) in the feeding direction (+Y-direction). By this step, the printing medium 201 is conveyed to the image printing position of the next line.

At S208, the CPU performs the image printing corresponding to one line. After the image printing operation at S208 is completed and the conveyance operation (S103) by the unit conveyance amount F, which results in the conveyance of the printing medium 201 to the image printing position of the next line, is performed is the same control as that in the first continuous printing mode.

As described above, in the present embodiment, in a case where the continuous printing is performed in the second continuous printing mode, the cutting operation of the previous page is performed during the printing operation of the next page. Further, the cutting operation timing of the previous page is adjusted so that it is possible to perform the cutting operation of the previous page only by the conveyance in the feeding direction.

Third Continuous Printing Mode

Figure 8:
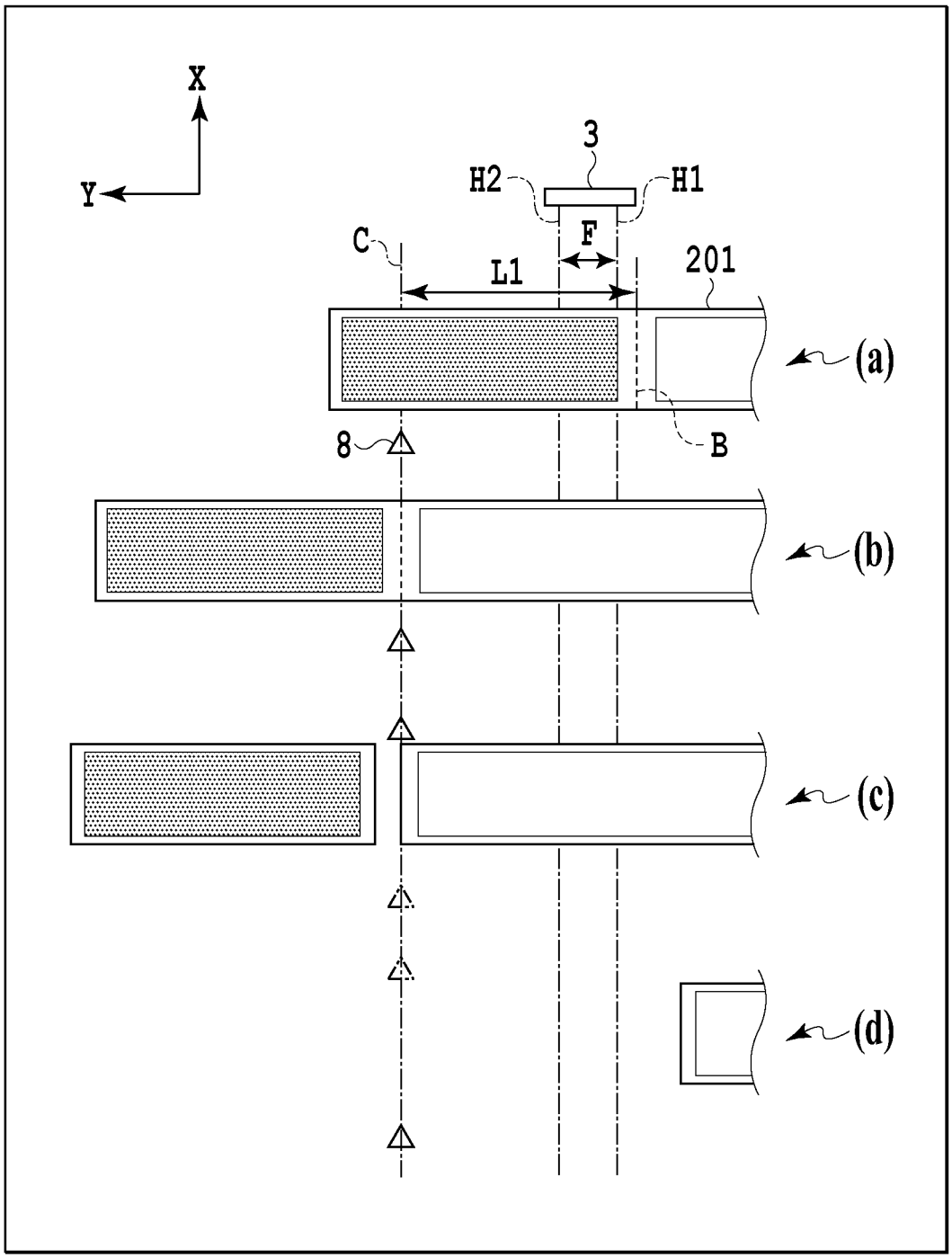
FIG. 8 is a diagram showing a state transition at the time of continuous printing onto roll paper in a third continuous printing mode.

In the following, a mode (referred to as third continuous printing mode) for continuously performing printing on roll paper in the image printing apparatus 100 in the present embodiment is explained by using FIG. 8. FIG. 8 shows a state transition at the time of continuous printing on roll paper in the third continuous printing mode.

In FIG. 8, a symbol (a) shows a state where the printing operation of the first page is completed. By using the nozzles of the print head 3 from the uppermost stream nozzle position H1 up to the downmost stream nozzle position H2 in the conveyance direction Y, the printing operation of the page 1 onto the printing medium 201 is completed.

In FIG. 8, a symbol (b) shows a state before the cutting operation of the first page is performed. Both in a case where the next print data has not been received and in a case where the next print data has been received, the printing medium 201 is conveyed by the conveyance amount L1 in the feeding direction (+Y-direction) with respect to the conveyance direction Y from the position shown in (a) of FIG. 8 up to the cutting position.

In FIG. 8, a symbol (c) shows a state after the cutting operation of the first page is performed and by the cutter 8 moving in the +X-direction from the first standby position indicated by the dotted line up to the cutting completion position indicated by the solid line, the first page is cut at the back end position B of the first page.

Next, in FIG. 8, a symbol (d) shows a state where the printing operation of the first page is completed and the operation (referred to as returning operation of cutter 8) of the cutter 8 returning in the −X-direction from the cutting completion position indicated by the dotted line up to the first standby position indicated by the solid line is performed. On the other hand, the printing medium 201 is conveyed in the returning direction (−Y-direction) with respect to the conveyance direction Y from the position shown in (c) of FIG. 8 up to the standby position. In a case where the next print data has been received, the printing medium 201 is conveyed from the position shown in (d) of FIG. 8 up to the start position of the image printing.

Because of this, in the third continuous printing mode, compared to the first continuous printing mode or the second continuous printing mode, the conveyance amount up to the cutting position is large and the conveyance amount up to the start position of the image printing of the next page after the cutting operation is also large, and therefore, it is not possible to efficiently perform the conveyance operation. Consequently, throughput is reduced.

On the other hand, in the first continuous printing mode or in the second continuous printing mode, during the printing of the second page, the cutting operation is performed, and therefore, the time interval from the image printing of the line before the cutting operation until the image printing of the line after the cutting operation is prolonged and becomes different from that of the other lines. Because of this, in multi-pass in which the image printing operation and the conveyance operation are repeated alternately and an image is formed by division into a plurality of lines, there is a possibility that image quality is reduced because drying unevenness occurs.

Printing Processing in Third Continuous Printing Mode

Figure 9:
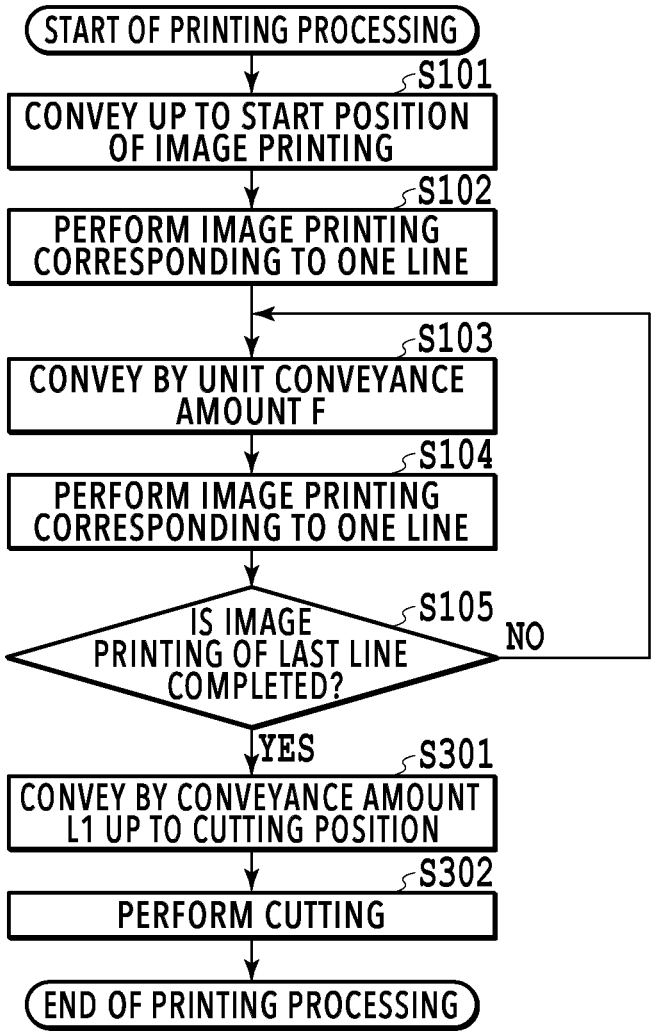
FIG. 9 is a flowchart of printing processing in the third continuous printing mode.

In the following, the series of processing in the third continuous printing mode in the present embodiment is explained by using FIG. 9. FIG. 9 is a flowchart of printing processing in the third continuous printing mode. The printing processing shown in FIG. 9 is started upon receipt of print data. Further, the processing at each step is performed by the CPU of the control unit 400.

S101 to S105 are the same as those in the first continuous printing mode and the second continuous printing mode (see FIG. 5, FIG. 7).

After S105, irrespective of whether or not the print data of the next page has been received, at S301, the CPU conveys the printing medium 201 by the conveyance amount L1 up to the cutting position. By this step, the back end position B of the page is moved to the cutting position C of the cutter 8.

At S302, the CPU cuts the printing medium 201 at the back end position B by operating the cutter 8. After that, the CPU returns the printing medium 201 in the returning direction (−Y-direction) up to the standby position and the printing processing is completed.

In a case where the next print data has been received, the printing medium 201 having returned to the standby position is conveyed again up to the start position of the image printing (S101) and an image is printed. As described above, in the third continuous printing mode, in a case where the continuous printing is performed, the cutting operation timing is adjusted so that the page cutting operation is performed for each page.

Switch Control Method of Continuous Printing Mode

In the following, the switch control method of the continuous printing mode in the present embodiment is explained by using FIG. 10. FIG. 10 shows an example of a table (referred to as continuous printing mode switch table) used at the time of switching the continuous printing modes.

In the example shown in FIG. 10, the continuous printing mode includes the first continuous printing mode, the second continuous printing mode, and the third continuous printing mode. Further, as print data, there are three kinds of print data, such as print data that gives priority to throughput by increasing the speed of the carriage 4 or setting the conveyance amount per line large and print data that gives priority to image quality by reducing the speed of the carriage 4 or setting the conveyance amount per line small. It is possible for the print mode setting unit 302 of the printer driver 301 to set one of these three kinds. Here, throughput is high in order of the first continuous printing mode, the second continuous printing mode, and the third continuous printing mode. On the other hand, image quality is high in order of the third continuous printing mode, the second continuous printing mode, and the first continuous printing mode. Consequently, in a case where print data gives priority to throughput, the first continuous printing mode is applied, in a case where it is desired to strike a balance between throughput and image quality, the second continuous printing mode is applied and in a case where priority is given to image quality, the third continuous printing mode is applied. By switching the continuous printing modes as described above, it is possible to selectively perform the printing operation appropriate for print data.

In the aspect described previously, the continuous printing modes are switched in accordance with print data, but it may also be possible to switch the continuous printing modes in accordance with the kind of printing medium.

Effects of the Present Embodiment

As explained above, in the present embodiment, in a case where the continuous printing is performed, the continuous printing modes are switched in accordance with print data. Because of this, it is possible to perform an optimum printing operation both in a case where priority is given to throughput and in a case where priority is given to image quality.

Third Embodiment

In the present embodiment, a modification example is explained in which the first continuous printing mode is developed into a tip cut operation in borderless printing.

Control at the Time of Borderless Tip Cut in Borderless Printing Operation

Figure 11:
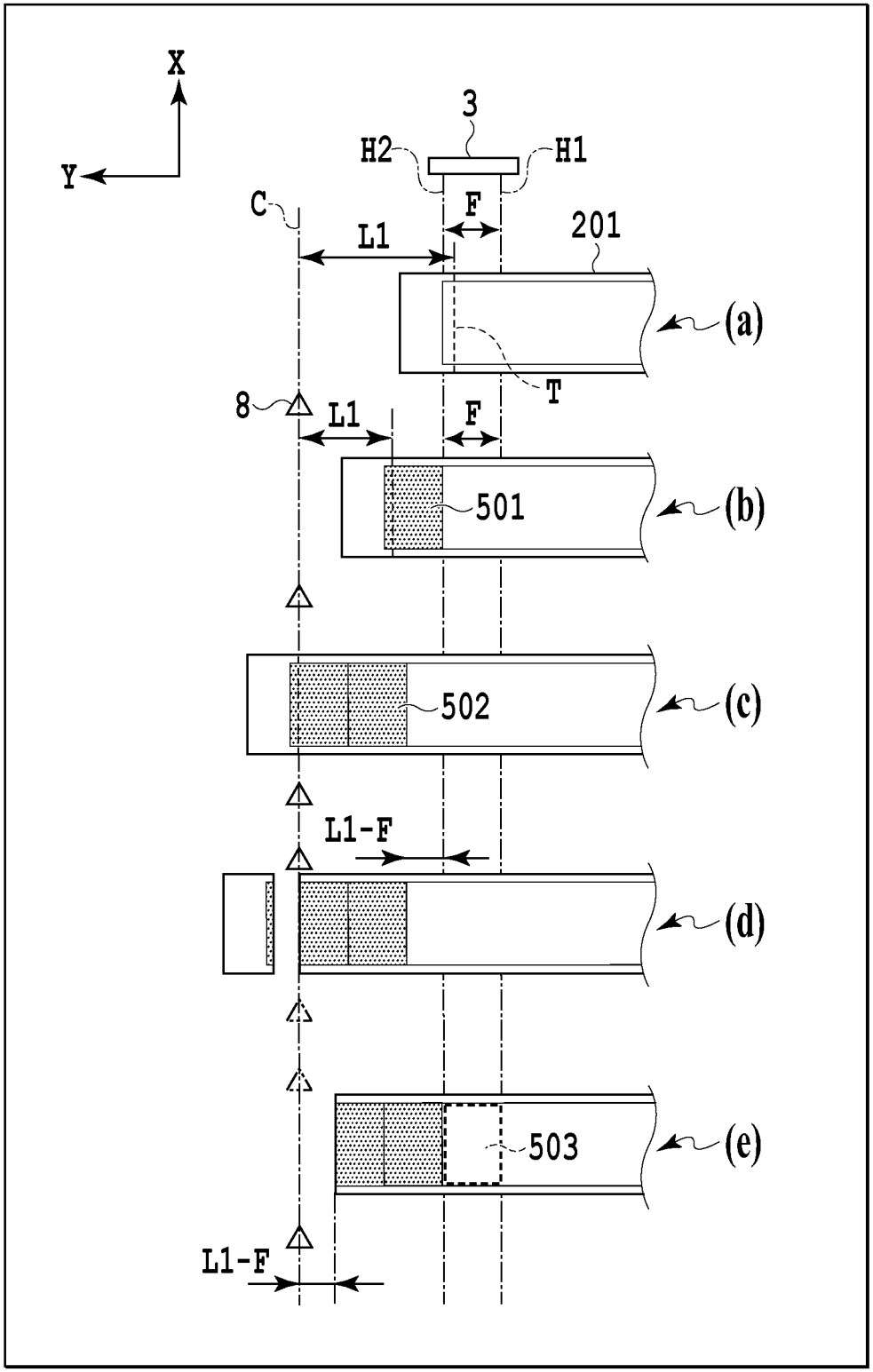
FIG. 11 is a diagram showing a state transition in a case where a borderless printing operation is performed onto roll paper.

In the following, control at the time of borderless tip cut of a borderless printing operation onto roll paper in the present embodiment is explained by using FIG. 11. FIG. 11 is a diagram showing a state transition in a case where the borderless printing operation is performed onto roll paper.

In FIG. 11, a symbol (a) shows a state where the printing medium 201 is conveyed to the start position of the image printing. In the borderless printing, an output material is generated by cutting an area (referred to as image-printed area) in which an image is printed in the printing medium 201 by the cutter 8, and therefore, a tip cut position T is in the image-printed area. Consequently, the distance between the cutting position C of the cutter 8 and the tip cut position T is the conveyance amount L1 up to the cutting position with respect to the conveyance direction Y. In the present embodiment also, as to the conveyance after the borderless printing operation is started and the image 501 of the first line is printed by the main scanning corresponding to one line by the forward movement or the backward movement of the carriage 4, the conveyance control is different in accordance with a relationship between the conveyance amount L1 and the unit conveyance amount F as in the first embodiment.

In FIG. 11, a symbol (b) shows a state where the printing operation is continued and before the image 502 of the second line is printed. Here, the conveyance amount (referred to as the unit conveyance amount F) for conveyance to the image printing position of the next line is taken as the distance between the uppermost stream nozzle position H1 and the downmost stream nozzle position H2. At the position of the printing medium 201 shown in (a) of FIG. 11, based on the unit conveyance amount F and the conveyance amount L1 up to the cutting position, whether to perform the cutting operation is determined. Specifically, $(2\times F)<L1$ holds, and therefore, the printing medium 201 is conveyed by the unit conveyance amount F in the feeding direction (+Y-direction) with respect to the conveyance direction Y from the position shown in (a) of FIG. 11 and the printing operation is continued. After that, the image 502 of the second line is printed.

Next, in FIG. 11, a symbol (c) shows a state where the printing operation is suspended and before the borderless tip cut operation is performed. At the position of the printing medium 201 shown in (b) of FIG. 11, based on the unit conveyance amount F and the conveyance amount L1 up to the cutting position, whether to perform the cutting operation is determined. Specifically, $(2\times F)\geq L1$ holds, and therefore, the printing medium 201 is conveyed by an amount corresponding to L1 in the feeding direction (+Y-direction) with respect to the conveyance direction Y from the position shown in (b) of FIG. 11 and the printing operation is suspended.

In FIG. 11, a symbol (d) shows a state after the borderless tip cut operation is performed and by the cutter 8 moving in the +X-direction from the first standby position indicated by the dotted line up to the cutting completion position indicated by the solid line, the printing medium 201 is cut at the tip cut position T.

Next, in FIG. 11, a symbol (e) shows a state where the borderless printing operation is resumed. Here, the operation (referred to as returning operation of cutter 8) of the cutter 8 returning in the −X-direction from the cutting completion position indicated by the dotted line up to the first standby position indicated by the solid line is performed. On the other hand, by the printing medium 201 being conveyed by an amount corresponding to (L1−F) in the returning direction (−Y-direction) with respect to the conveyance direction Y from the position shown in (d) of FIG. 11, the printing medium 201 reaches the position at which the image 503 of the third line is printed. After that, by printing the image 503 of the third line, the borderless printing operation is resumed. As described above, even in a case where the borderless printing operation is resumed after the borderless tip cut operation, the first conveyance operation of the printing medium 201 is in the returning direction (−Y-direction) with respect to the conveyance direction Y, and therefore, the printing medium 201 is not conveyed to the downstream side of the cutting position C of the cutter 8. Consequently, it is made possible to perform the borderless printing operation and the returning operation of the cutter 8 in parallel. In a case where the returning operation of the cutter 8 is completed and the printing of the image 503 of the third line is also completed, it is possible to continue the printing operation of the fourth and subsequent lines.

Effects of the Present Embodiment

As explained above, in the present embodiment, the timing of the borderless tip cut operation during the borderless printing operation is determined based on the unit conveyance amount and the conveyance amount up to the cutting position. Then, the timing of the borderless tip cut operation is adjusted so that the conveyance operation after the cutting is in the returning direction. By designing the configuration such as this, it is made possible to perform the conveyance operation in the returning direction of the printing medium, which results in the resumption of the printing operation of the next page, and the image printing operation in parallel to the cutter returning operation. Consequently, it is made possible to efficiently perform the cutter returning operation after the borderless tip cut operation, and therefore, throughput is improved.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to one embodiment of the present invention, in an image printing apparatus having a cutting device that needs to be returned to a standby position for a next cutting operation, it is possible to improve throughput of continuous printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-013366, filed Jan. 30, 2020, which is hereby incorporated by reference wherein in its entirety.

What is claimed is:

1. An image printing apparatus comprising:

a printing unit;

a conveyance unit capable of conveying a printing medium in a conveyance direction or in a returning direction opposite to the conveyance direction;

a cutting unit provided at a cutting position on a downstream side in the conveyance direction of the printing unit and configured to cut the printing medium by moving in a first direction and return to a cutting standby position for a next cutting operation by moving in a second direction opposite to the first direction; and a control unit configured to perform a first conveyance operation of the printing medium in the conveyance direction by the conveyance unit after a printing operation for a target page is suspended and then to perform a cutting operation by the cutting unit, wherein the control unit performs a second conveyance operation of the printing medium in the returning direction by the conveyance unit during movement in the second direction of the cutting unit after the cutting operation.

2. The image printing apparatus according to claim 1, wherein as a result of the conveyance operation, a back end of a previous page of the target page becomes the cutting position.

3. The image printing apparatus according to claim 1, wherein a printing operation of the target page after the cutting operation includes an image printing operation for printing an image of the target page by the printing unit after the second conveyance operation.

4. The image printing apparatus according to claim 3, wherein a conveyance amount in a conveyance operation in the returning direction of the printing medium by the conveyance unit after the cutting operation is equal to a difference between a distance from a back end position of a previous page of the target page to the cutting position and a unit conveyance amount.

5. The image printing apparatus according to claim 1, wherein the image printing apparatus operates in one of a first continuous printing mode, a second continuous printing mode, and a third continuous printing mode and in the first continuous printing mode:

during a printing operation for the target page, a conveyance operation by the conveyance unit is performed so that a back end of a previous page of the target page becomes the cutting position; and after the cutting operation to separate the previous page by the cutting unit is performed, a printing operation to print the target page by the printing unit is resumed after a conveyance operation of the printing medium in the returning direction by the conveyance unit is performed.

6. The image printing apparatus according to claim 5, wherein in the second continuous printing mode:

during a printing operation for the target page, a conveyance operation by the conveyance unit is performed so that a back end of a previous page of the target page becomes the cutting position; and after the cutting operation to separate the previous page by the cutting unit is performed, a printing operation to print the target page by the printing unit is resumed after a conveyance operation of the printing medium in the conveyance direction by the conveyance unit is performed.

7. The image printing apparatus according to claim 6, wherein in the third continuous printing mode, the cutting operation to separate the previous page by the cutting unit is performed before a printing operation for the target page.

8. The image printing apparatus according to claim 7, wherein in which of the first continuous printing mode, the second continuous printing mode, and the third continuous printing mode an operation is performed is based on print data.

9. The image printing apparatus according to claim 7, wherein in which of the first continuous printing mode, the second continuous printing mode, and the third continuous printing mode an operation is performed is based on a kind of the printing medium.

10. The image printing apparatus according to claim 1, wherein as the cutting standby position, there are a first standby position and a second standby position closer to the printing medium than the first standby position and in a state where a tip of the printing medium is located on a downstream side in the conveyance direction of the cutting position, the cutting unit is moved from the first standby position to the second standby position.

11. The image printing apparatus according to claim 10, wherein in a first continuous printing mode and a second continuous printing mode, the cutting operation is performed from the second standby position, and in a third continuous printing mode, the cutting operation is performed from the first standby position.

12. The image printing apparatus according to claim 1, further comprising:

a determination unit configured to determine whether to perform a printing operation of the target page or to perform the cutting operation based on a unit conveyance amount and a distance between a back end of a previous page of the target page and the cutting position.

13. The image printing apparatus according to claim 1, further comprising:

a carriage that moves the printing unit in a direction perpendicular to the conveyance direction.

14. The image printing apparatus according to claim 1, wherein by alternately performing a conveyance operation by a unit conveyance amount by the conveyance unit and an image printing operation for the printing medium by the printing unit, a printing operation based on print data is performed.

15. The image printing apparatus according to claim 1, wherein the printing unit prints an area of the printing medium between a down position and an upper position in the conveyance direction, and in the first conveyance operation, part of an area of the printing medium to be printed next is conveyed to a downstream side of the down position.

16. The image printing apparatus according to claim 1, wherein a first conveyance amount by the first conveyance operation is not smaller than a second conveyance amount by the second conveyance operation.

17. A control method of an image printing apparatus comprising:

a printing unit;

a conveyance unit capable of conveying a printing medium in a conveyance direction or in a returning direction opposite to the conveyance direction;

a cutting unit provided at a cutting position on a downstream side in the conveyance direction of the printing unit and configured to cut the printing medium by moving in a first direction and return to a cutting standby position for a next cutting operation by moving in a second direction opposite to the first direction, and the control method comprising:

performing a first conveyance operation of the printing medium in the conveyance direction by the conveyance unit after a printing operation for a target page is suspended and then performing a cutting operation by the cutting unit, performing a second conveyance operation of the printing medium in the returning direction by the conveyance unit during movement in the second direction of the cutting unit after the cutting operation.

18. The control method according to claim 17, wherein as a result of the conveyance operation, a back end of a previous page of the target page becomes the cutting position.

19. The control method according to claim 17, wherein a printing operation of the target page after the cutting operation includes an image printing operation for printing an image of the target page by the printing unit after the second conveyance operation.

20. The control method according to claim 19, wherein a conveyance amount in a conveyance operation in the returning direction of the printing medium by the conveyance unit after the cutting operation is equal to a difference between a distance from a back end position of a previous page of the target page to the cutting position and a unit conveyance amount.

21. The control method according to claim 17, wherein the printing unit prints an area of the printing medium between a down position and an upper position in the conveyance direction, and in the first conveyance operation, part of an area of the printing medium to be printed next is conveyed to a downstream side of the down position.

22. The control method according to claim 17, wherein a first conveyance amount by the first conveyance operation is not smaller than a second conveyance amount by the second conveyance operation.

* * * * *